US009526379B2

(12) United States Patent
Hoernig et al.

(10) Patent No.: US 9,526,379 B2
(45) Date of Patent: Dec. 27, 2016

(54) ENCLOSURE WITH STORAGE

(75) Inventors: Victor Hoernig, Lowell, IN (US); Geraint Krumpe, Chicago, IL (US); Man Ki Yoo, Skokie, IL (US)

(73) Assignee: Delta Faucet Company, Indianapolis, IN (US)

( * ) Notice: Subject to any disclaimer, the term of this patent is extended or adjusted under 35 U.S.C. 154(b) by 1718 days.

(21) Appl. No.: 12/773,342

(22) Filed: May 4, 2010

(65) Prior Publication Data

US 2011/0271439 A1 Nov. 10, 2011

(51) Int. Cl.
*A47K 3/00* (2006.01)
*A47K 3/28* (2006.01)

(52) U.S. Cl.
CPC ..... *A47K 3/283* (2013.01); *A47K 3/281* (2013.01)

(58) Field of Classification Search
CPC ..... A47K 3/281; A47K 3/282; A47K 3/283; A47K 3/284; A47K 3/004
USPC ..... 4/596, 609–614, 600; 312/242, 249.8, 312/249.11; 211/175, 105.3, 105.1, 123; 248/298.1, 257, 265, 269
See application file for complete search history.

(56) References Cited

U.S. PATENT DOCUMENTS

| | | | | | |
|---|---|---|---|---|---|
| 231,984 | A | * | 9/1880 | Bement | 4/550 |
| 1,664,716 | A | * | 4/1928 | Wiberg | 24/543 |
| 2,894,644 | A | * | 7/1959 | Magnuson et al. | 211/206 |
| 3,905,662 | A | * | 9/1975 | Richmond | 312/249.8 |
| 4,669,790 | A | * | 6/1987 | Briggs | 312/223.3 |
| 4,987,619 | A | * | 1/1991 | Smith | 4/612 |
| 5,134,813 | A | * | 8/1992 | Betts | 52/92.3 |
| 5,340,234 | A | * | 8/1994 | Rossi et al. | 405/48 |
| 5,901,508 | A | * | 5/1999 | Menzel | 52/34 |
| 6,381,773 | B1 | * | 5/2002 | McAllister | 4/604 |
| 6,443,318 | B1 | * | 9/2002 | Welsch | 211/90.02 |
| 7,624,542 | B2 | | 12/2009 | Hatrick-Smith | |

* cited by examiner

*Primary Examiner* — Erin Deery
(74) *Attorney, Agent, or Firm* — Carlson, Gaskey & Olds, PC

(57) ABSTRACT

A unit for filling an area having a floor, a first side wall, a second side wall and a back wall has a pan, a shower area, a zero threshold drain, a frame, a space created by the frame and the second side wall and a storage unit disposed in the space. A shower area is defined by a first panel, a second panel and a third panel and has an opening through which a user may enter, the opening also being defined by the panels. The first panel is adapted to be disposed against the first side wall and the pan and the second panel is adapted to be disposed against the second side wall and the pan. The zero threshold drain is disposed across the opening. The frame is adapted to support the third panel and create the space between the second side wall and the frame.

34 Claims, 8 Drawing Sheets

ENCLOSURE WITH STORAGE

BACKGROUND OF THE INVENTION

This application relates to shower enclosures and more particularly to shower enclosures that replace existing bath units with a shower enclosure and storage.

As people age, existing bath and shower enclosures may no longer meet their bathing needs. People may wish to have grab bars and easy access to shower enclosures and water controls to enhance their bathing experience.

Typical bath and shower enclosures are 60 inches wide from side to side and 30 inches from front to back. Such a bath and shower enclosure may be placed in a recess in a bathroom, the recess being formed by a bathroom back wall and two sidewalls of the room.

SUMMARY OF THE INVENTION

According to an exemplar, a unit for filling an area having a floor, a first side wall, a second side wall and a back wall has a pan, a shower area, a zero threshold drain, a frame, a space created by the frame and the second side wall and a storage unit disposed in the space. The shower area is defined by a first panel, a second panel and a third panel and has an opening through which a user may enter, the opening also being defined by the panels. The first panel is adapted to be disposed against the first side wall and the pan and the second panel is adapted to be disposed against the second side wall and the pan. The zero threshold drain is disposed across the opening. The frame is adapted to support the third panel and create a space between the second side wall and the frame.

A kit for replacing an enclosure having bathtub, shower or other space disposed in an area having a first side wall, a second side wall and a back wall, has a pan, a first panel, a second panel and a third panel for creating a shower area and an opening through which a user may enter, the opening to being defined by the panels, the first panel is adapted to be disposed against the first side wall and the pan and the second panel is adapted to be disposed against the second side wall and the pan, a zero threshold drain for being disposed across the opening, a frame and abutting the pan, the frame being adapted to support the third panel and create an opening between the second side wall and the frame, and a storage unit adapted to be disposed in the space.

A unit for replacing an enclosure disposed in an area having a floor, a first side wall, a second side wall and a back wall, has a shower area having a first panel, a second panel and a third panel and an opening through which a user may enter, the opening being defined by the panels, the first panel is disposed against the first side wall and the second panel is disposed against the second side wall, a frame, the frame supporting the third panel and creating an opening between the second side wall and the frame, and a storage unit disposed in the space.

These and other features of the present invention can be best understood from the following specification and drawings, the following of which is a brief description.

DETAILED DESCRIPTION OF THE PREFERRED EMBODIMENT

Figure 1:
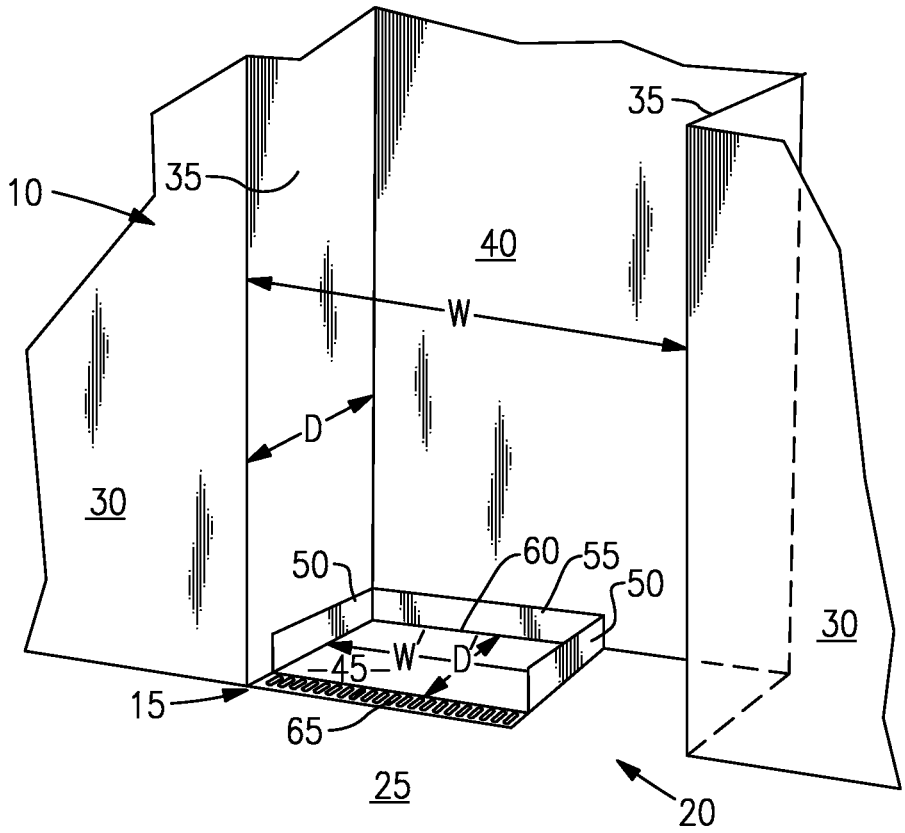
FIG. 1 relates to a shower pan disposed in a recess in which a bath shower has been removed.

Referring now to FIG. 1, an opening 10 for use with a shower and storage unit 15 described herein is partially shown in a bathroom 20. The bathroom has a floor 25, a pair of front walls 30, a pair of side walls 35 and a back wall 40.

The opening 10 is sized to fit a standard size tub (not shown), which may have shower equipment such as a shower head or a hand shower (not shown). The opening 10 usually has a width W of 60 inches and a depth D of 30 inches or more, i.e. the dimensions of a standard tub (not shown). The depth D is typically more than the 30 inches to allow a tub (not shown) to be recessed from front walls for decorative or other purposes. The depth D shown herein is 39" inches though other depths are contemplated herein.

A pan 45 having two sidewalls 50 and a back wall 55 and a bottom 60 is disposed on the floor 25 of the opening 10. The pan has a zero threshold drain 65. The zero threshold drain is flush with the floor 25. Such zero threshold drain is disclosed in the assignee's patent application entitled BATH SYSTEM, Ser. No. 12/533,046, filed Jul. 31, 2009, which is incorporated herein by reference. The zero threshold drain 65 allows a user to access the pan 45 without having to step over an edge (not shown) so that tripping is minimized The zero threshold drain 65 is typically as wide as the pan 45 and about 3 inches deep, though other depths are contemplated herein.

Figure 2:
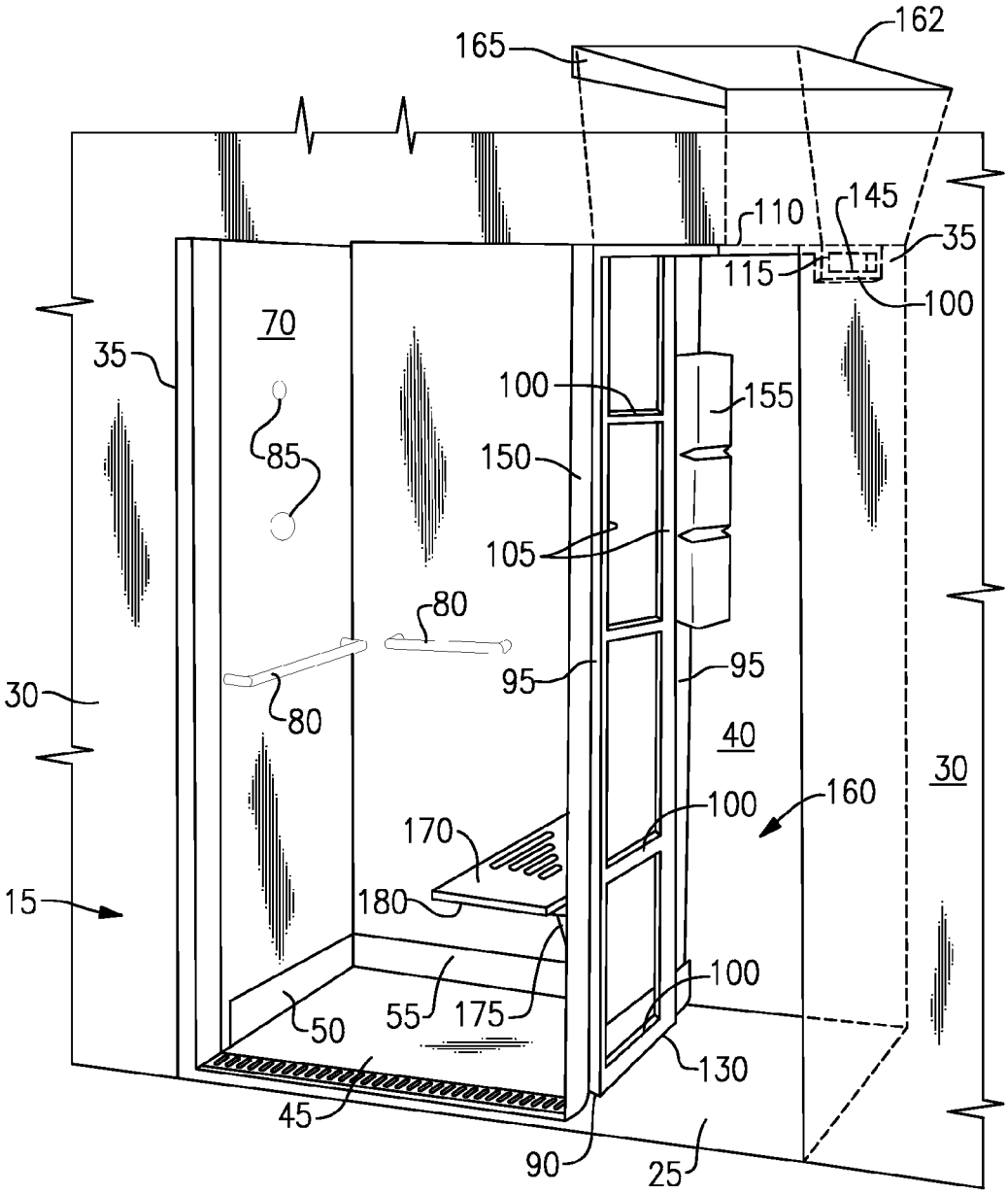
FIG. 2 shows a shower enclosure that cooperates with the pan of FIG. 1 and a frame.

Referring now to FIG. 2, a shower left side wall 70 and a shower back wall 75 are installed against the left side wall 35 and back wall 40 of the opening 10 as is known in the art. The shower left side wall 70 and shower back side wall 75 are sealed against the left wall 50 of the pan 45 and the back wall 55 of the pan 45 respectively and against each other as is known in the art to minimize any leakage therefrom. A pair of grab bars 80 is installed against studs (not shown) or otherwise in the respective side wall and back wall as is known in the art. The shower left side wall 70 typically has a plurality of openings 85 for allowing plumbing fixtures such as a temperature and volume regulator and a stub out for a shower head (not shown) as is known in the art.

Figure 2A:
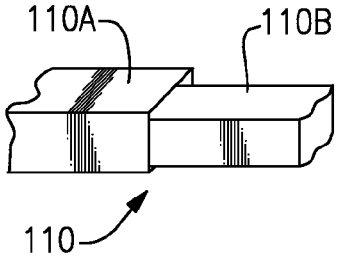
FIG. 2A shows a telescoping frame of FIG. 2.

Next, a frame 90, which may be prefabricated, is attached to the floor 25 of the opening 10 and the right side wall 35 in the opening 10 to provide support for the installed shower and storage unit 15 as will be described herein. The frame 90 has a pair of side portions 95 that are connected by welding or the like by a plurality of stiles 100. Each side portion has a vertical portion 105, an upper portion 110 that cants slightly from horizontal and a shorter downwardly extending portion 115. Referring to FIG. 2A, the upper portion 110 may be split into a smaller section 110B that telescopes into larger section 110A so that the upper portion can fit by telescoping to attach to the right side wall 35 if irregular widths W (see FIG. 1) are encountered, e.g., other than 60 inches. The frame is recessed from a front of the shower enclosure and storage unit 15.

Figure 2B:
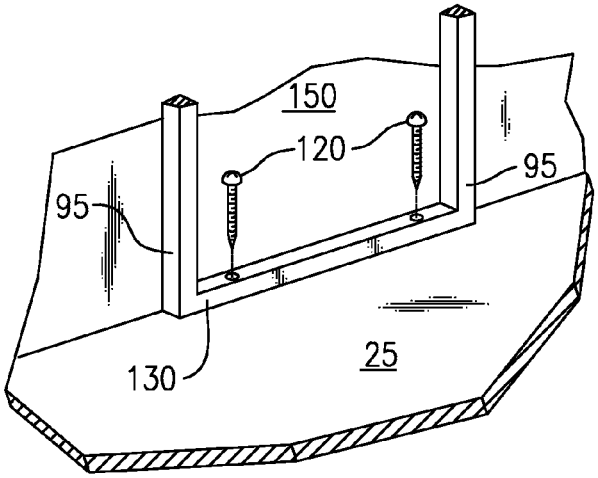
FIG. 2B shows an attachment of the frame of FIG. 2.
Figure 2C:
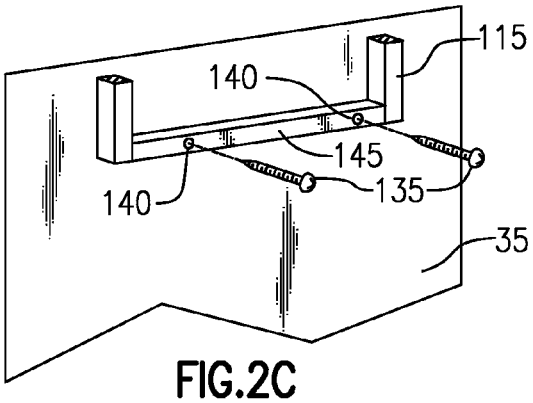
FIG. 2C shows an attachment of the frame of FIG. 2.

As shown in FIG. 2B, bolts 120 are used to extend through holes 125 in a bottom stile 130 into the floor 25. Similarly as shown in FIG. 2C, bolts 135 are used to extend through holes 140 in stile 145 extending between downwardly extending portion 115 into the right side wall 35. Other securement means are also contemplated herein.

Referring now back to FIG. 2, a shower right side wall 150 is sealingly installed against the back wall 40 or the shower back wall 75, the pan 45 and against the frame 90. The attachment may be by glue, clips or screws or the like as is known in the art. The shower right side wall includes a hidden storage portion 155 that is designed to hold soap and shampoo or the like (not shown) in the shower enclosure.

A space 160 is created between the shower right side wall 150 and the right side wall 35. The space has a depth D (see FIG. 1) that is the same as the depth D' of the pan 45 and the width of the zero threshold drain though other depths are contemplated. As will be shown hereinbelow, the space 160 will be advantageously used.

Referring again to FIG. 2, a top portion 162 is secured to the upper portion 110 of the frame 90. The top portion has a flange 165 depending downwardly therefrom that fits over the shower right side wall 150. As stated above, the upper portion 110 is canted slightly from horizontal and the top portion 162, which conforms to the upper portion so that if any is water splashed up on the top portion 162, it will flow downwardly towards the shower enclosure, over the flange 165 and into the shower enclosure thereby minimizing any water flow outside the shower enclosure. The top portion 162 also provides a solid surface for additional storage.

Figure 2D:
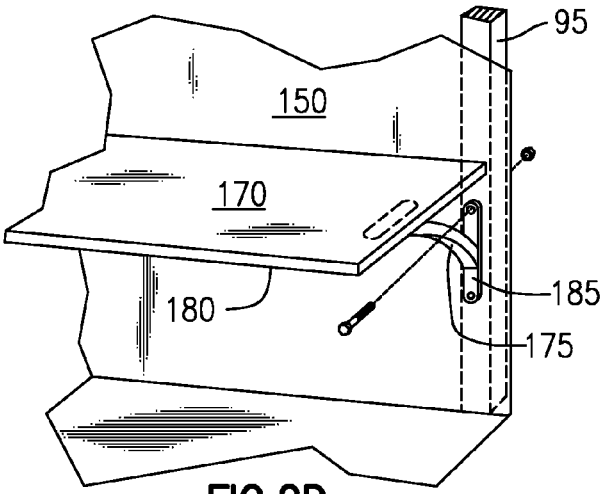
FIG. 2D shows an attachment of a seat to the frame of FIG. 2.

Referring now to FIGS. 2 and 2D, a shower seat 170 is installed. The shower seat 170 has a bracket 175 that attaches conventionally to the bottom 180 of the shower seat 170, to the shower right side wall 150 via faceplate 185 and through the shower right side wall 150 into the frame 90. As can be seen in FIG. 2D, bolt 190 and a nut 195 are used to secure the shower seat 170 to the frame 90 via faceplate 185 and bracket 175.

Referring now to FIGS. 3-7, storage units 200 are shown that may be placed within the space 160. The storage units 200 have a width that fits within the space and a depth that is generally just short of the width of a hidden storage unit 155 placed in the shower right side wall 150. The hidden storage unit 155 will not interfere with objects that are placed in the opening that have a depth less than the width of the right side wall and the width of the hidden storage.

Figure 3:
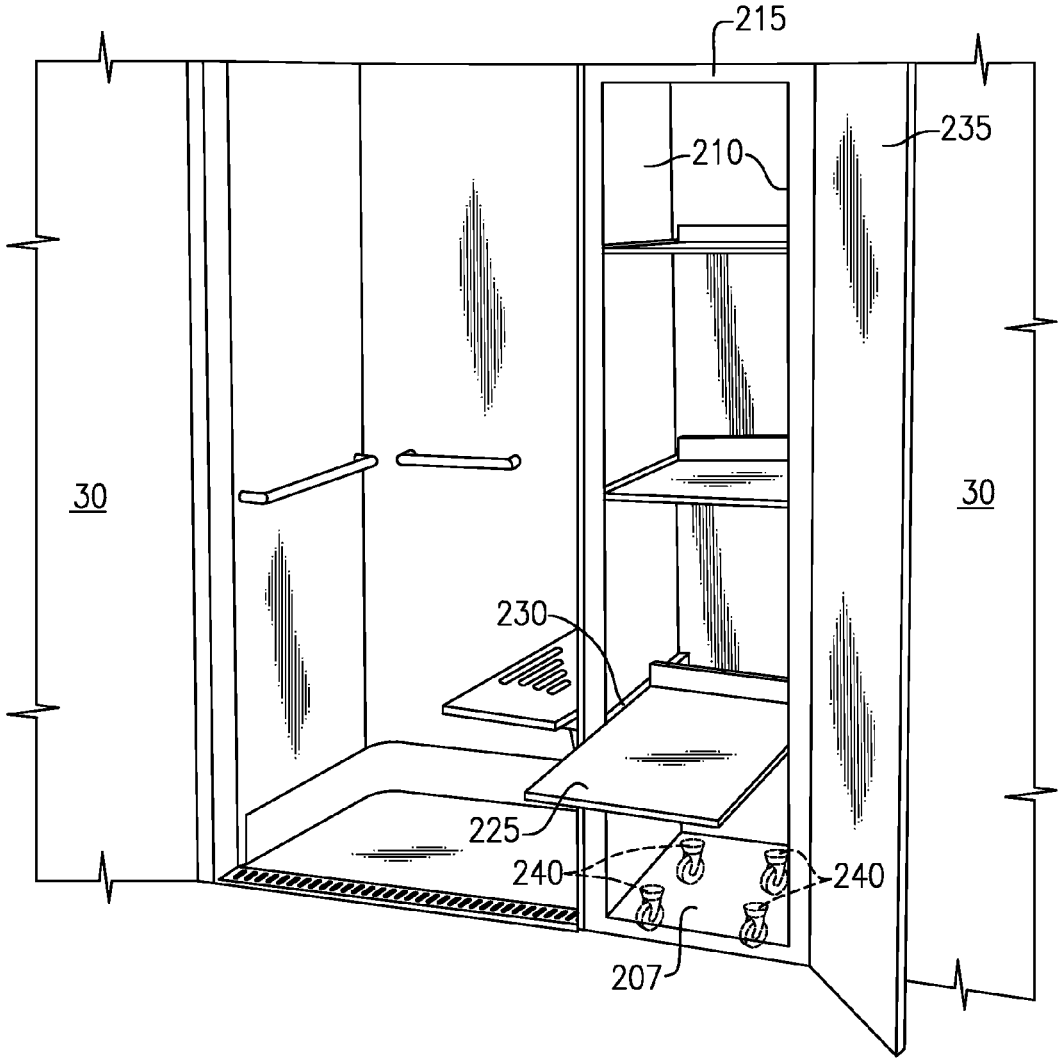
FIG. 3 shows a storage cabinet installed in a space created by the installation of the shower enclosure and frame of FIG. 2.

Referring specifically to FIG. 3, a storage unit 205 shows a floor 207, two side walls 210, molding 215, back wall 220 and three shelves 225 that extend inwardly and outwardly on guides 230. The storage unit may also have a door 235 to maintain a neat appearance. The storage unit may be mounted on casters 240 so that the storage unit 205 may be slid easily into and out of the space 160 if a different storage unit is desired. The door 235 may show decor that matches the room's design.

Figure 4:
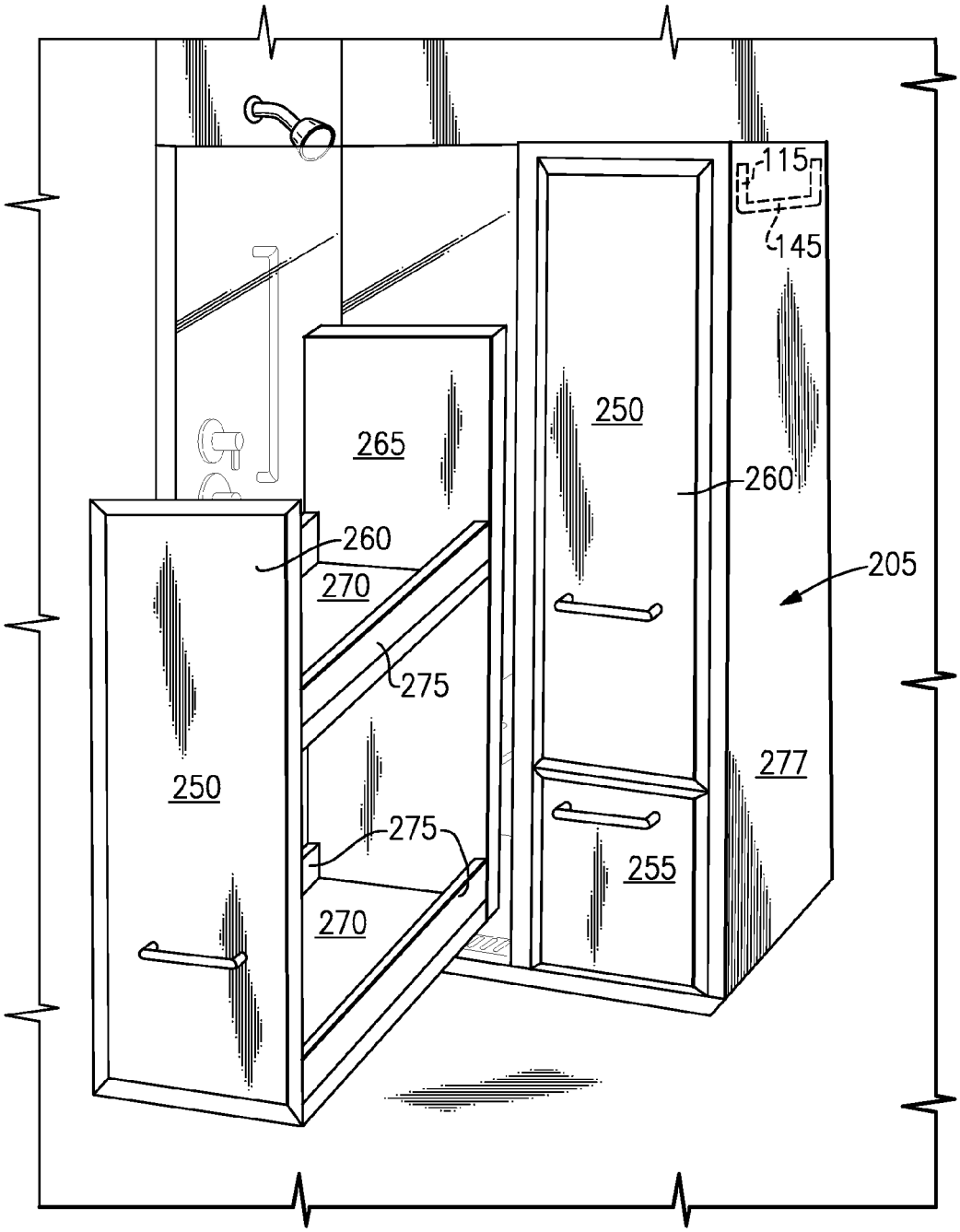
FIG. 4 shows another embodiment of a storage cabinet including a shower door.

Referring to FIG. 4, another storage unit 245 is shown. The storage unit has an upper drawer 250 and a lower drawer 255. The upper drawer a front wall 260, a back wall 265 and a pair of shelves 270 extending from the front wall to the back wall thereof. A set of partitions 275 prevent items from falling off the shelves. The upper shelf is mounted on guides (see 230 in FIG. 3).

The lower drawer 255 is a sliding box that can function as a laundry basket or the like.

This storage unit 245 has a solid right side wall 277 if the storage unit is installed where there is not a side wall 35. In this case, the stile 145 attaches directly to the solid right side wall 277.

Figure 5:
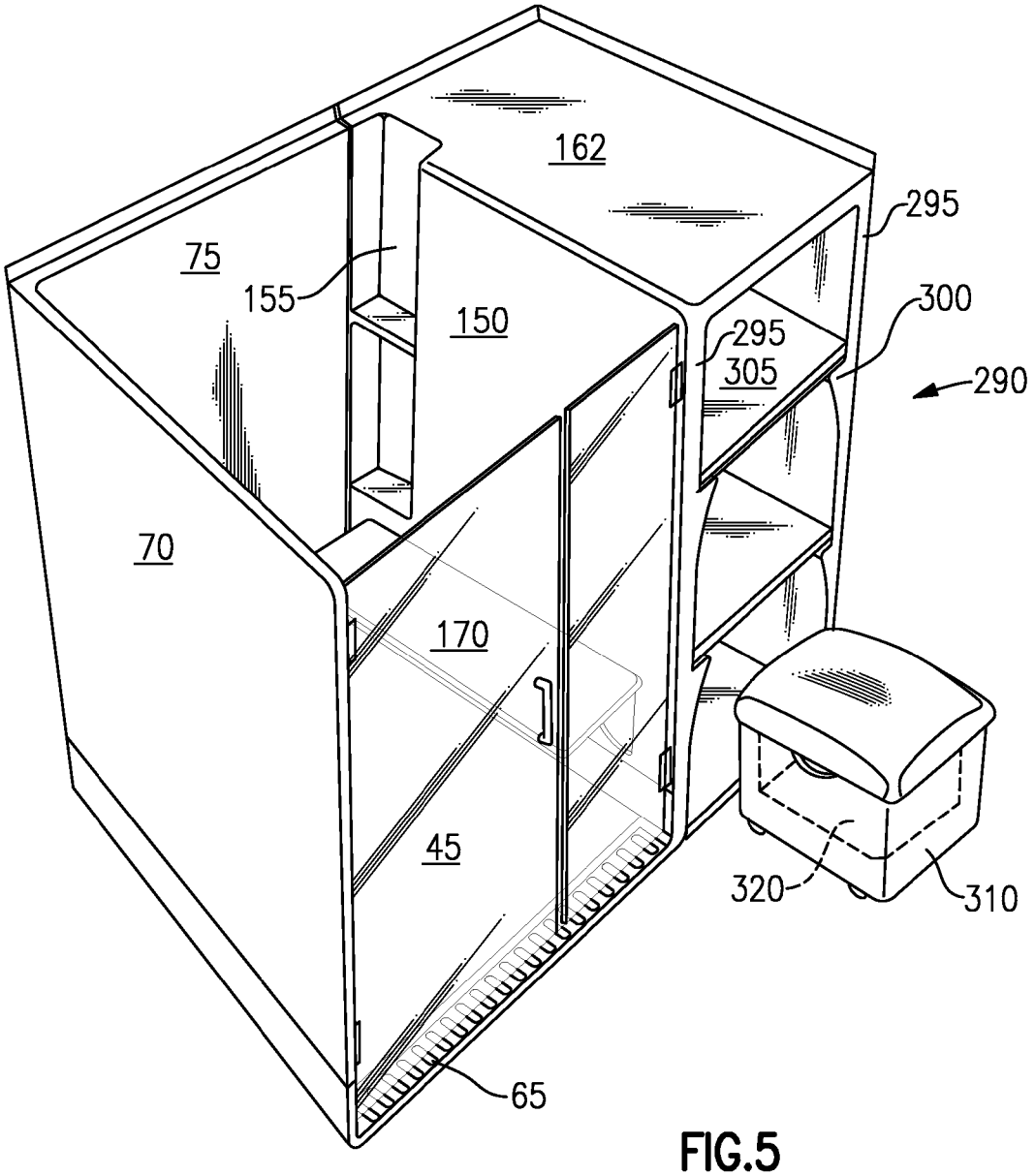
FIG. 5 shows another embodiment of a storage cabinet including a shower door.

Referring to FIG. 5, a shower door 280, which may be a double panel 285 or a single panel (see FIG. 6), may be installed on the shower left side wall 35 and the shower right side wall 150 as is known in the art. However, other styles of shower doors are also contemplated herein. The storage unit 290 has a pair of sides 295 having molded slides 300 to hold shelves 305. A sliding bench 310 having a comfortable seat 315 fits under the bottom shelf 307 within the storage unit 290. The bench may have a hidden storage area 320 under the seat 315.

Figure 6:
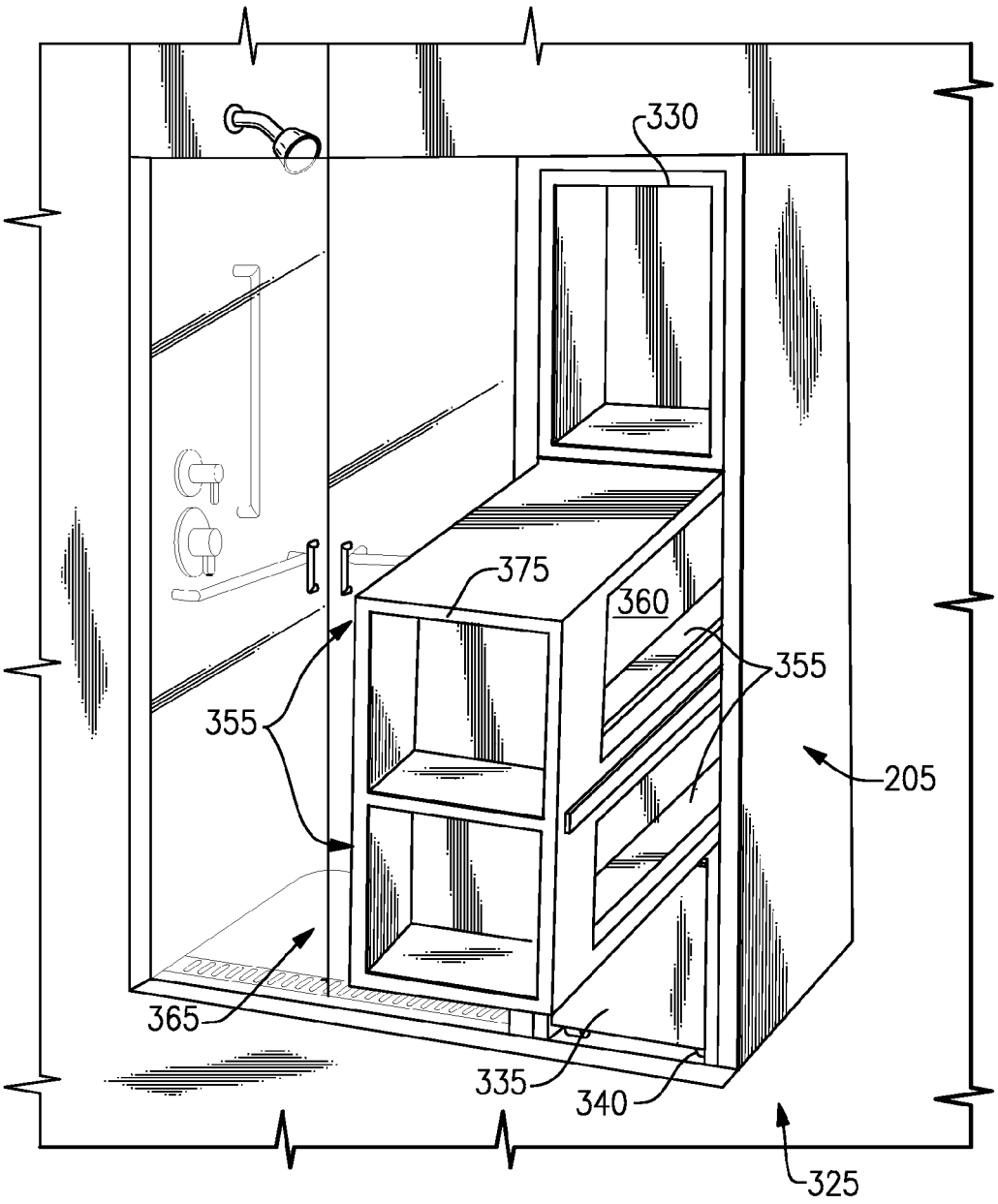
FIG. 6 shows another embodiment of a storage cabinet including a shower door.

Referring to FIG. 6, another storage unit 325 is shown having a fixed top shelf 330, a lower drawer 335 mounted on casters 340, and a slidable drawer 350 having four storage areas 355 extending along a length of the drawer 350, two on either side thereof, separated by partition 360 and another open storage area 365 having a shelf 370 on the front 375 thereof.

Figure 7:
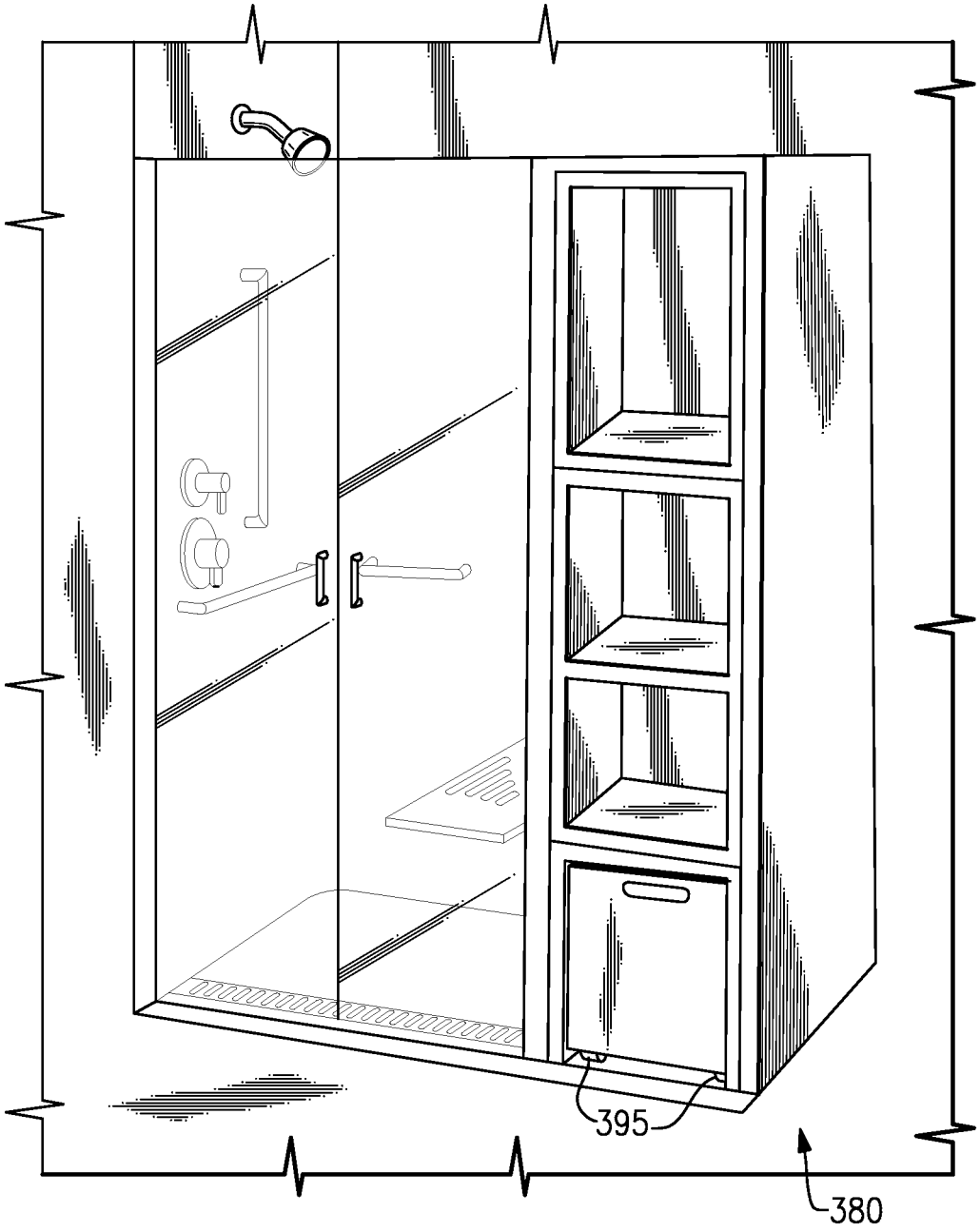
FIG. 7 shows another embodiment of a storage cabinet including a shower door.

Referring finally to FIG. 7, another embodiment of a storage unit 380 is shown having three fixed shelves 385 and a laundry hamper 390 mounted on casters 395.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A unit for filling an area having a floor, a first side wall, a second side wall and a back wall, said unit comprising:

a pan disposed on or above said floor, a shower area having a first panel, a second panel and a third panel and an opening through which a user may enter, said opening being defined by said first, second and third panels, said first panel is adapted to be disposed against said first side wall and said pan, and said second panel is adapted to be disposed against said back wall and said pan, a zero threshold drain disposed across said opening and abutting said pan, a frame, said frame being adapted to support said third panel and create a space between said second side wall and said frame, and a storage unit disposed in said space.

2. The unit of claim 1 wherein said frame is adapted to extend from said third panel to said second side wall.

3. The unit of claim 2 wherein said frame has a first section and a second section slideably received therein to extend from said third panel to said second side wall.

4. The unit of claim 1 further including a shower door disposed across said opening.

5. The unit of claim 1 wherein said storage unit has a plurality of shelves therein.

6. The unit of claim 5 wherein said storage unit is enclosed by a door.

7. The unit of claim 5 wherein said shelves are slideably mounted.

8. The unit of claim 5 wherein said storage unit includes drawers.

9. The unit of claim 1 wherein said storage unit includes a bench.

10. The unit of claim 9 wherein said storage unit includes a drawer.

11. The unit of claim 9 wherein said storage unit includes a shelf.

12. The unit of claim 1 wherein said storage area has a plurality of drawers slideably mounted therein.

13. The unit of claim 1 wherein said frame includes a first vertical portion adapted for attaching to said floor and a canted portion extending from a top of said first portion at an angle relative thereto.

14. The unit of claim 13 further comprising a top disposed along said canted portion wherein water splashed upon said top flows into said shower area.

15. The unit of claim 13 further comprising a second vertical portion extending from said canted portion and adapted for attaching to said second side wall.

16. The unit of claim 1 further comprising a top disposed over said space wherein water splashed upon said top flows into said shower area.

17. The unit of claim 1 further comprising a seat disposed in said shower area for attaching to said frame through said third panel.

18. The unit of claim 1 wherein said first panel is installed directly against said first side wall and said second panel is installed directly against said back wall.

19. The unit of claim 1 wherein said frame is attached to said floor and said second side wall, said frame comprising at least two side portions that are connected to each other with a plurality of stiles.

20. The unit of claim 19 wherein each side portion includes a vertical portion and an upper portion that cants from horizontal in a direction toward said shower area.

21. The unit of claim 20 wherein said frame includes a top portion secured to said upper portion of said frame, said top portion comprising a solid surface including downwardly extending flange that overlaps said third panel.

22. The unit of claim 1 wherein said third panel is defined by a first depth and wherein said frame is defined by a second depth that is less than the first depth.

23. A unit for replacing a bathtub or a shower disposed in an area having a floor, a first side wall, a second side wall and a back wall, said unit comprising:

a shower area having a first panel, a second panel and a third panel and an opening through which a user may enter, said opening being defined by said panels, said first panel is disposed against said first side wall and said second panel is disposed against said back wall, a frame, said frame supporting said third panel and creating a space between said second side wall and said frame, and a storage unit disposed in said space.

24. The unit of claim 23 wherein said first panel is installed directly against said first side wall and said second panel is installed directly against said back wall.

25. The unit of claim 23 wherein said frame is attached to said floor and said second side wall, said frame comprising at least two side portions that are connected to each other with a plurality of stiles.

26. The unit of claim 25 wherein each side portion includes a vertical portion and an upper portion that cants from horizontal in a direction toward said shower area.

27. The unit of claim 23 wherein said third panel is defined by a first depth and wherein said frame is defined by a second depth that is less than the first depth.

28. A kit for filling an area having a first side wall, a second side wall and a back wall, said kit comprising:

a first panel, a second panel and a third panel for creating a shower area and an opening through which a user may enter, said opening to being defined by said panels, said first panel is adapted to be disposed against said first side wall and said second panel is adapted to be disposed against said back wall, a zero threshold drain for being disposed across said opening, a frame, said frame being adapted to support said third panel and create a space between said second side wall and said frame, and a storage unit adapted to be disposed in said space.

29. The kit of claim 28 wherein said frame is adapted to extend from said third panel to said second side wall.

30. The kit of claim 29 wherein said frame has a first section and a second section slideably received therein to extend from said third panel to said second side wall.

31. The kit of claim 28 wherein said first panel is adapted to be installed directly against said first side wall and said second panel is adapted to be installed directly against said back wall.

32. The kit of claim 28 wherein said frame is adapted to be attached to said floor and said second side wall, said frame comprising at least two side portions that are connected to each other with a plurality of stiles, and wherein each side portion includes a vertical portion and an upper portion that cants from horizontal in a direction toward said shower area.

33. The kit of claim 32 wherein said frame includes a top portion secured to said upper portion of said frame, said top portion comprising a solid surface including downwardly extending flange that overlaps said third panel.

34. The kit of claim 28 wherein said third panel is defined by a first depth and wherein said frame is defined by a second depth that is less than the first depth.

* * * * *